United States Patent [19]

Evenson

[11] Patent Number: 4,535,896

[45] Date of Patent: Aug. 20, 1985

[54] FOLDING, EXTENSIBLE HOLDER

[75] Inventor: Mel Evenson, San Pedro, Calif.

[73] Assignee: Eldon Industries, Inc., Inglewood, Calif.

[21] Appl. No.: 527,331

[22] Filed: Aug. 29, 1983

[51] Int. Cl.[3] ..... A47G 19/08

[52] U.S. Cl. ..... 211/41; 211/43

[58] Field of Search ..... 211/41, 43, 11, 175; 248/542; 312/234, 234.5

[56] References Cited

U.S. PATENT DOCUMENTS

| | | | |
|---|---|---|---|
| 851,571 | 4/1907 | Timberlake | 211/41 |
| 1,006,328 | 10/1911 | Widenhofer | 211/43 X |
| 1,108,893 | 9/1914 | Ellinwood | 211/71 X |
| 1,750,576 | 3/1930 | Cubberley | 211/43 X |
| 2,545,844 | 3/1951 | Cougias | 211/43 |
| 4,106,735 | 8/1978 | Partain et al. | 211/43 X |
| 4,181,282 | 1/1980 | Oliver et al. | 248/542 X |

*Primary Examiner*—Ramon S. Britts
*Assistant Examiner*—Sarah A. Lechok
*Attorney, Agent, or Firm*—Edward D. O'Brian; K. H. Boswell

[57] ABSTRACT

A folding, extensible holder primarily intended for use in holding file folders of various different lengths but which is capable of being used in holding other objects can be constructed so as to utilize a sectionalized base in which the sections are connected by a tongue and groove structure and opposed ends held by the base. The base construction permits the length of the base to be adjusted to correspond to various standardized lengths of folders and other objects capable of being held with the holder. Detents are provided for releasably securing the sections in various positions corresponding to such lengths. Preferably, the sections of the base may be disengaged and the ends of the folder may be folded relative to the sections upon which they are located into flat, easily shipped configurations.

6 Claims, 8 Drawing Figures

FOLDING, EXTENSIBLE HOLDER

BACKGROUND OF THE INVENTION

The invention set forth in this specification pertains to new and improved holders. More specifically, it pertains to holders which are primarily adapted to be utilized in holding file folders and various other items commonly encountered in offices.

Many different structures have, of course, been developed and used in holding such file folders and other various related items such as envelopes. This invention is primarily concerned in holders which support such objects in vertical positions in such a manner that the contents of file folders are not apt to fall out of such folders and in such a manner that a single folder can easily be selected from a group of folders.

Such holders have commonly been constructed so as to utilize a generally elongated, generally rectilinear base provided with upstanding ends at the opposed ends of the base. These upstanding ends have normally been shaped so as to engage and support various objects in the holder so that such objects extend vertically. In order to facilitate the shipment of such holders, it is known to construct them so that the ends used are pivotally mounted upon the base in such a manner that they can be shipped parallel to the base and to construct these holders to include detents or detent means securing these ends so that they extend vertically when they are unfolded to an operative position.

Although structures of this type are unquestionably highly utilitarian, certain problems have been encountered in connnection with them. These problems center about the fact that various different standardized paper sizes are commonly utilized. A holder of the type indicated in the preceding is normally constructed so as to be utilized with only objects of a given or standardized length. As a consequence of this, a stationery store desiring to supply the needs of all of its customers has to stock various different holders of different standardized lengths. Economics makes this disadvantageous. Further, a customer cannot utilize non-adjustable holders as indicated with file folders, envelopes and various different objects of different standardized lengths.

BRIEF SUMMARY OF THE INVENTION

As a result of these considerations, it is considered that there is a need for new and improved holders of a type as indicated in the preceding discussion. This invention is intended to fulfill or statisfy this need. More specifically, it is intended to provide folding, extensible holders which can be manipulated or adjusted so as to be utilized with file folders, envelopes and other objects of different lengths. The invention is also intended to provide holders which may be easily and conviently manufactured at a comparatively nominal cost, which may be adjusted to various lengths as normally desired with minimal difficulty and which are capable of satisfactorily serving their intended function of holding various objects so that such objects extend vertically.

In accordance with this invention, these and various other objectives of this invention are achieved in a holder for use in supporting elongated, generally rectilinear, substantially flat objects, said holder having an elongated generally rectangular base and upstanding ends located at opposed ends of said base, said upstanding ends being shaped so as to engage and support objects held in said holder in a vertical position the improvement which comprises: said base being formed so as to include two separate sections, one of said sections being located adjacent to one of said upstanding ends, the other of said sections being located adjacent to the other of said upstanding ends, interfitting tongue and groove means for adjustably connecting said sections located on said sections, said tongue and groove means on said sections being capable of being manipulated so as to vary the length of said base so as to allow said holder to be utilized with objects of varying lengths, and co-acting detent means located on said sections for holding said sections relative to one another in various positions such that the spacing between said upstanding ends approximately corresponds to standard lengths of various objects capable of being held in said holder.

BRIEF DESCRIPTION OF THE DRAWINGS

Because of the nature of this invention, it is best more fully explained with reference to the accompanying drawing in which.

Figure 1:
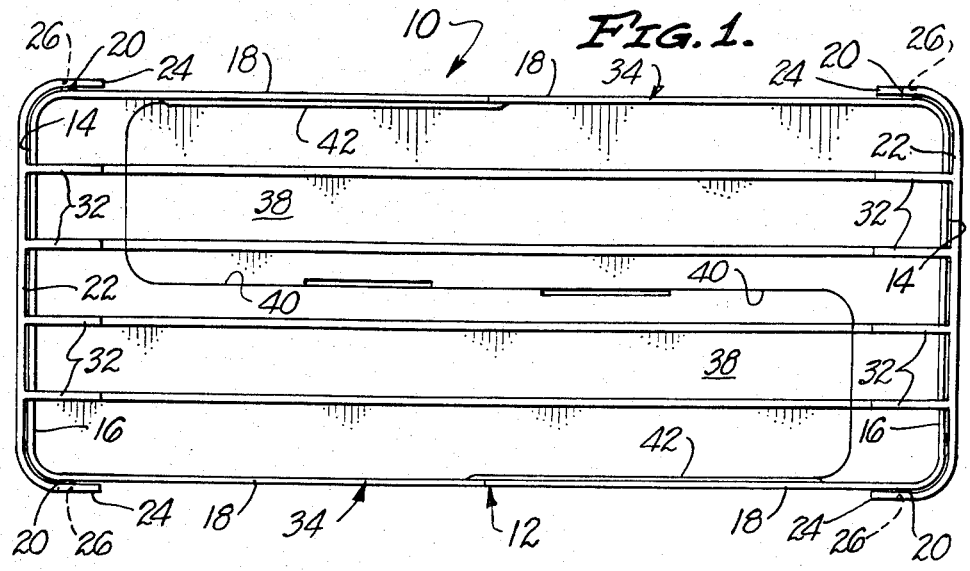
FIG. 1 is a top plan view of a presently preferred embodiment or form of a folding, extensible holder of the present invention in an unfolded configuration in which the holder is shown with the ends positioned so that the holder will accommodate letter sized folders as are commonly used in the United States of America.

The particular holder illustrated in the drawings is constructed so as to utilize the operative concepts or principles of this invention set forth and claimed in the appended claims forming a part of this specification. These concepts or principles may be easily embodied within other, somewhat differently appearing, somewhat differently constructed holders through the use or exercise of routine engineering skill as is commonly employed in connection with the design of new items of office equipment. For this reason, the drawings are not to be taken as limiting this invention and the invention is to be considered as encompassing any structure coming within the scope of the appended claims.

DETAILED DESCRIPTION

In the drawings there is shown a folding, extensible holder 10 in accordance with this invention which utilizes an elongated, generally rectilinear base 12. This base 12 has opposed ends 14 which include vertically extending walls 16. The base 12 also includes side walls 18 which appear more or less as continuations of the end walls 16. Small pins 20 in the nature of bosses are provided on the side walls 18 adjacent to the end walls 16 for the purpose of pivotally supporting normally vertically extending upstanding ends 22. These ends 22 are provided with side flanges 24 which generally overlie the side walls 18 and which are provided with bearing openings 26 receiving the pins 20.

With this construction, these ends 22 can be manipulated between a folded configuration in which they overlie the base 12 with the flanges 24 going alongside of the side walls 18 to a vertical position as shown. Although it is not always desirable or necessary, a known detent type of connection can be utilized to maintain these ends 22 vertically. In the holder 10 such a detent structure (not separately numbered) consists of two separate detent ridges 28 and 30 which together constitute a complete "detent means". These ridges 28 and 30 are designed to snap over one another as the ends 22 are being moved to a vertical position in a conventional or established manner. If desired, vertically extending ribs 32 may be located on the ends 22 for the purpose of stabilizing folders, envelopes and the like.

Figure 2:
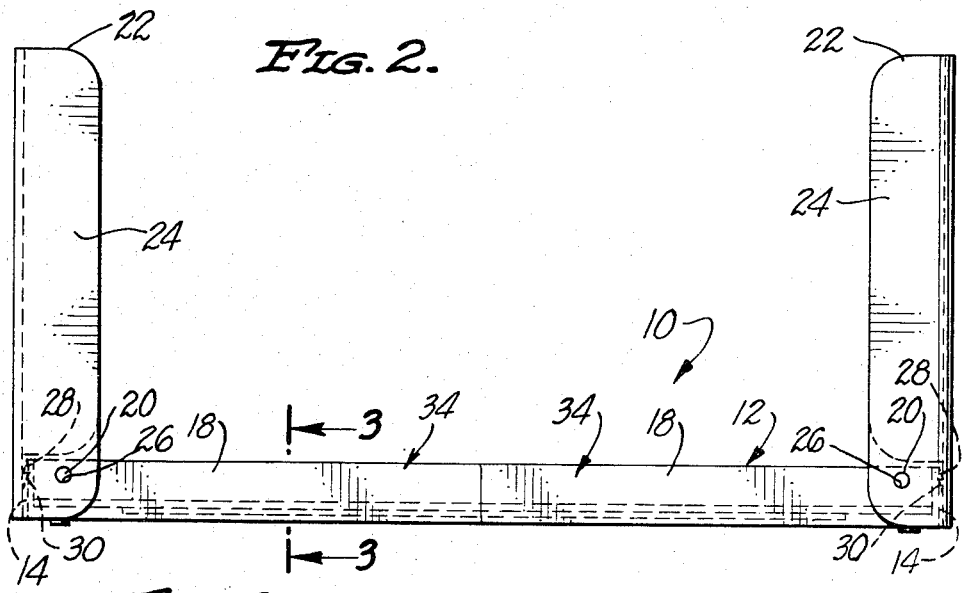
FIG. 2 is a side elevational view of the holder shown in FIG. 1 as it appears in FIG. 1.
Figure 3:
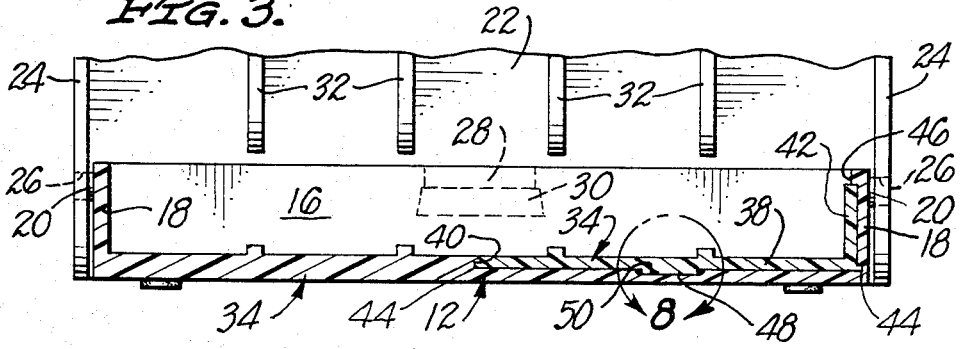
FIG. 3 is a partial cross-sectional view at an enlarged scale taken at line 3—3 of FIG. 2.

Those parts of the holder 10 which have been described up to this portion of this specification directly correspond to physical structures such as have been previously sold in the office products industry. The present invention is concerned with the modification of such a known structure as hereinafter indicated. This modification involves forming the base 12 so that it consists of two separate sections 34. When these sections 34 are located, as shown in FIGS. 1, 2, and 4 of the drawings, with the holder 10 being adjusted to hold so-called letter sized folders, bottom edges 36 on these sections 34 fit precisely against one another and a tongue 38 on each of these sections 34 completely fills a groove 40 on the other of these sections 34.

Each of these tongues 38 is provided with an upstanding side wall 42 and with extensions 44. These extensions 44 fit in grooves 40 in the sections 34. These tongues 38 are normally blocked against other than sliding movement out of the grooves 40 by means of lips 46 on the side walls 18 engaging the side walls 42. In any of the various pre-determined desired positions of the sections 34, as hereinafter described, these sections 34 are held or locked against undesired movement by a detent structure (not separately numbered) including an elongated rib 48 and any of a series of different grooves 50 adapted to contain the rib 48. The sections 34 are normally sufficiently resilient so as to permit the rib 48 to be snapped from any one of the grooves 50 to any one of the other of the grooves 50.

Figure 4:
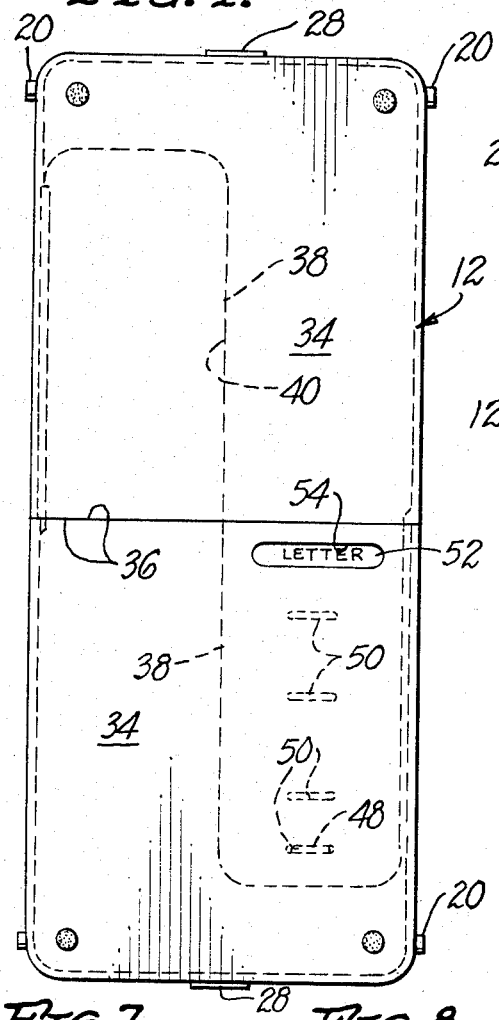
FIG. 4 is a bottom plan view of the holder shown in FIG. 1 as it appears in FIG. 1.
Figure 5:
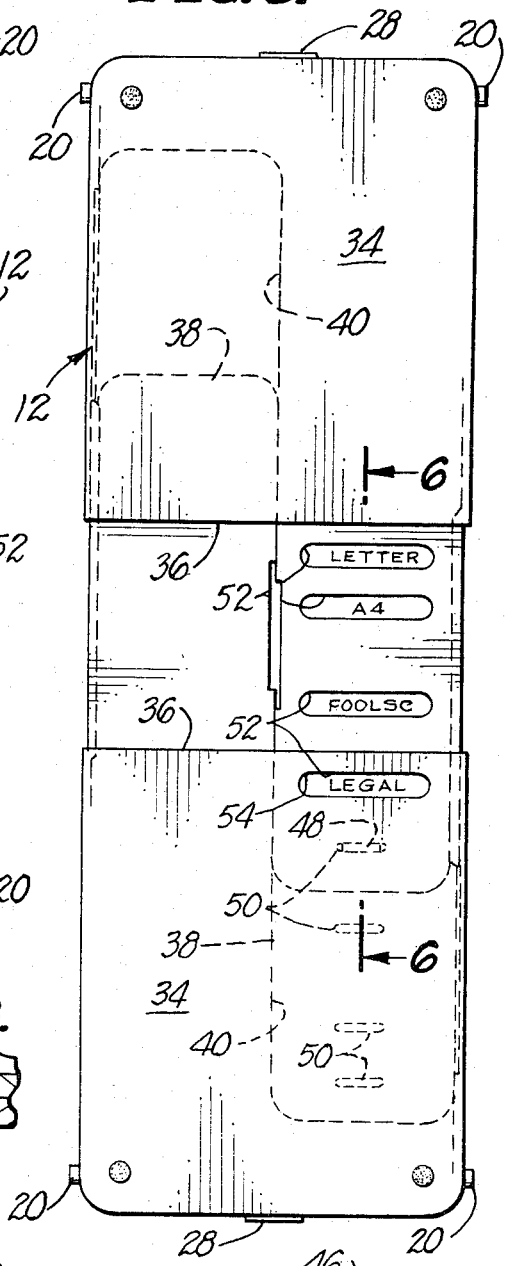
FIG. 5 is a view corresponding to FIG. 4 showing the bottom of the holder as it appears when the holder is expanded to hold or support so-called legal sized files as are used in the United States of America.
Figure 7:
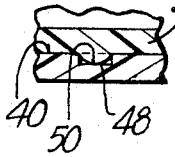
FIG. 7 is an enlarged fragmentary view designated by the circle 7 in FIG. 6.
Figure 8:
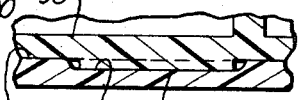
FIG. 8 is an enlarged fragmentary view covering the part of FIG. 3 designated by the circle 8 in FIG. 3.
Figure 6:
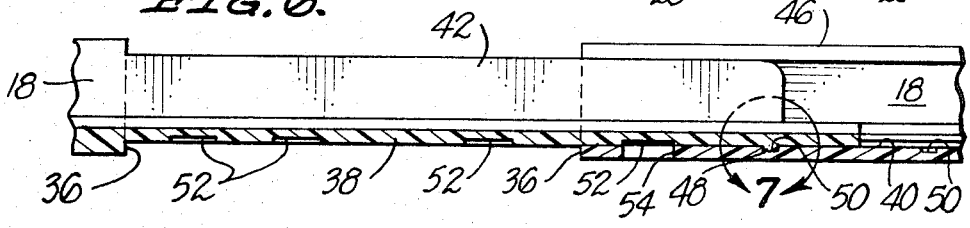
FIG. 6 is a partial cross-sectional view at an enlarged scale taken at line 6—6 of FIG. 5.

The various pre-determined positions of the sections 34 are indicated by legends designated by the words "Letter", "A-4", "Foolscap" and "Legal" as are apparent in FIGS. 4 and 5 of the drawings. No effort is made herein to designate these legends by various numerals. Each of them is formed in a small depression 52 in one of the sections 34 so that its legibility will not be harmed as a result of repeated manipulation of the holder 10. A window 54 is provided in one of the sections 34 for the purpose of indicating with reference to the legend appearing under this window 54 that the holder 10 has been manipulated so as to be primarily useful with folders or envelopes of a type normally used with paper of the size designated by the legend. The grooves 50 are, of course, located so that when the ribs 48 are in one of these grooves 50 a specific legend will appear through the window 54.

The construction of the holder 10 has an unexpected advantage over and above the advantage of being able to be used with objects of various different standardized or other lengths. Because of the fact that the base 12 is composed of two sections 34 which are movable with respect to one another, it is possible to supply the holder 10 with the sections 34 unattached to one another. As a consequence of this, these sections 34 can be shipped separately when flat with ends 14 of any desired length or height such as the length or height corresponding in length to the side edge of a folder. This makes it possible to utilize the holder 10 in connection with relatively tall folders provided with suspending clips. It would not have been possible to provide a prior holder utilizing folding ends corresponding to the ends 14 with ends of such a large or tall dimension because of the problem of the ends abutting one another when folded unless, of course, a specialized structure for this purpose was employed. With this invention, no such structure is needed or required.

I claim:

1. In a holder for use in supporting elongated, generally rectilinear, substantially flat objects, said holder having an elongated, generally rectangular base and upstanding ends located at opposed ends of said base, said upstanding ends being shaped so as to engage and support objects held in said holder in a vertical position the improvement which comprises:

said base being formed so as to include two separate sections, one of said sections being located adjacent to one of said upstanding ends, the other of said sections being located adjacent to the other of said upstanding ends, interfitting tongue and groove means for adjustably connecting said sections located on said sections, said tongue and groove means on said sections being capable of being manipulated so as to vary the length of said base so as to allow said holder to be utilized with objects of varying lengths, co-acting detent means capable of being snapped apart located on said sections for holding said sections relative to one another in various positions such that the spacing between said upstanding ends approximately corresponds to standard lengths of various objects capable of being held in said holder, said ends are pivotally mounted upon said sections and are capable of being pivoted between a flat folded position in which they extend along said position and a normal position in which they extend outwardly from said base, and other co-acting resilient detent means capable of being snapped apart for holding said ends so that they extend outwardly from said base.

2. A holder as claimed in claim 1 wherein:

said tongue and groove means are shaped so as to prevent other than sliding movement in adjusting the length of said base between said sections.

3. A holder as claimed in claim 1 including:

legend means for designating different paper sizes located on one of said sections and window means for designating specific of said legend means in accordance with the relative positions between said sections located on the other of said sections, and wherein, said detent means are located so as to hold said sections in various positions corresponding to specific of said legend means being designated by said window means.

4. A holder as claimed in claim 1 including:

legend means for designating different paper size located on one of said sections and window means for designating specific of said legend means in accordance with the relative positions between said sections located on the other of said sections, and wherein, said detent means are located so as to hold said sections in various positions corresponding to specific of said legend means being designated by said window means, said tongue and groove means are shaped so as to prevent other than sliding movement in adjusting the length of said base between said sections.

5. A holder as claimed in claim 1 wherein:

said opposed ends include vertically extending ribs located on the portions of said ends which face one another when said ends are in said normal position.

6. A holder as claimed in claim 4 including:

said opposed ends include vertically extending ribs located on the portions of said ends which face one another when said ends are in said normal position.

* * * * *